US005498064A

United States Patent [19]

Hooker et al.

[11] Patent Number: 5,498,064

[45] Date of Patent: Mar. 12, 1996

[54] SEAT UNIT

[76] Inventors: John A. Hooker, deceased, 135 Magna Road, late of Bear Wood, Dorset, BH11 9NE; by Christopher J. Hooker, legal representative, 53 Francis Avenue, West Howe, Bournemouth, Dorset, both of England

[21] Appl. No.: 305,697

[22] Filed: Sep. 14, 1994

[30] Foreign Application Priority Data

Sep. 14, 1993 [GB] United Kingdom ..... 9319024

[51] Int. Cl.[6] ..... A61G 15/00

[52] U.S. Cl. ..... 297/339; 297/338; 297/DIG. 10; 297/344.1

[58] Field of Search ..... 297/339, 338, 297/DIG. 10, 344.1, 344.14, 411.3, 411.37, 411.38

[56] References Cited

U.S. PATENT DOCUMENTS

| | | | |
|---|---|---|---|
| 3,473,174 | 10/1969 | Cool | 297/339 X |
| 4,587,678 | 5/1986 | Love et al. | 297/DIG. 10 X |
| 4,637,654 | 1/1987 | Beardman | 297/DIG. 10 X |
| 4,685,731 | 8/1987 | Migut | 297/339 X |
| 4,778,217 | 10/1988 | Lane | 297/DIG. 10 X |
| 4,838,612 | 6/1989 | Cross | 297/DIG. 10 X |
| 4,907,303 | 3/1990 | Baird | 297/339 X |
| 4,929,022 | 5/1990 | Geraci | 297/DIG. 10 X |
| 4,979,726 | 12/1990 | Geraci | 297/DIG. 10 X |
| 5,011,224 | 4/1991 | Paul | 297/339 |
| 5,082,327 | 1/1992 | Crisp | 297/DIG. 10 X |
| 5,116,100 | 5/1992 | Iversen | 297/DIG. 10 X |
| 5,265,935 | 11/1993 | Geisler et al. | 297/DIG. 10 X |
| 5,294,179 | 3/1994 | Rudes et al. | 297/DIG 10 X |
| 5,333,931 | 8/1994 | Weddendorf | 297/DIG. 10 X |
| 5,346,280 | 9/1994 | Deumite | 297/344.1 X |
| 5,372,404 | 12/1994 | Bratell et al. | 297/338 |

FOREIGN PATENT DOCUMENTS

| | | | |
|---|---|---|---|
| 1093588 | 12/1967 | United Kingdom | A47C 1/00 |
| 1277210 | 6/1972 | United Kingdom | A47C 15/00 |
| 2191683 | 12/1987 | United Kingdom | A61G 5/00 |
| WO9303087 | 2/1994 | WIPO | A47C 1/02 |

*Primary Examiner*—Peter M. Cuomo
*Assistant Examiner*—Rodney B. White
*Attorney, Agent, or Firm*—Cushman Darby & Cushman

[57] ABSTRACT

A seat unit includes a frame structure and a seat. A linkage assembly interconnects the frame structure and the seat for displacement of the seat relative to the frame structure between a lowered sitting position and a raised position to provide assistance for the person using the seat unit to stand up therefrom. The linkage assembly causes the rearward part of the seat to be raised by a greater distance than the front part so that the seat also tilts forwardly. First and second springs urge the seat towards its raised position, the springs being operable in combination to produce an overall spring force urging the seat towards its raised position with a spring force value which is of a desired magnitude in each part of the movement towards the raised position.

15 Claims, 2 Drawing Sheets

SEAT UNIT

BACKGROUND OF THE INVENTION

The present invention relates to a seat unit intended for example to enable disabled or elderly persons to sit down on and stand up from the seat more easily.

It is often found that disabled and/or elderly persons but also persons who may be suffering from various kinds of infirmity such as physical injury may find it difficult to sit down in and stand up from a seat, without calling on the assistance of another person. That may happen because the muscles of the person wishing to sit down or stand up are insufficiently strong or cannot be satisfactorily controlled, to raise and lower the body under full control over the whole range of movement between a sitting and a standing position.

While a seat may include a spring which urges the seat portion towards a raised position to assist the occupant to stand, it is found that the spring-loaded movement is difficult to control, even to such an extent as to 'catapault' the occupant to the upright position, with severe loss of balance.

SUMMARY OF THE INVENTION

An object of the present invention is to provide a seat unit which while being of a simple design configuration nonetheless effectively assists movement of the occupant towards a standing position.

Another object of the present invention is to provide a seat unit affording assistance for the occupant to stand in a controlled fashion.

Still another object of the present invention is to provide a seat unit which has a seat portion that lifts the occupant towards a standing position in a smooth and properly managed manner but without requiring active participation on the part of the occupant in terms of actuating control members.

In accordance with the principles of the present invention the foregoing and other objects are attained by the seat according to the invention as set forth herein.

Preferably, the first and second spring means co-operate in such a way that the overall spring force urging the seat portion towards its second position is at least substantially constant over the range of movement from the first position towards the second position.

In a preferred feature, the linkage means comprises a scissor-type assembly, the legs constituting the assembly being of respective lengths such as to produce the upward and forward tilting movement of the seat portion. The scissor-type assembly preferably comprises a first pair of legs and a second pair of legs, with the first and second pairs being in crossed relationship and pivotally connected together in such a way that the lengths of the leg portions of each pair at one side of the pivot connection are shorter than the lengths of the leg portions of each pair at the other side of the pivot connection, thereby to produce the forward tilting movement of the seat portion as it moves towards its second position.

Preferably, the first spring means comprises a torsion spring disposed at the pivot connection of the scissor-type assembly, the torsion spring having leg portions urging the seat portion towards its second position. The second spring means preferably comprises a tension spring acting on at least one leg of the scissor-type assembly.

Preferably, the frame structure comprises first and second hollow frame members which in use fit upon a toilet pan at respective sides thereof. Disposed in each of the frame members is a tension spring of which one end, being at the front of the frame structure, is towards the front of the toilet pan to which the unit is fitted. The second end of each tension spring is connected, for example by hooking engagement, with a slider slidably disposed in the respective frame member. The slider carries a pivot mounting for pivotal connection thereto of an appropriate leg of the scissor-type assembly. The tension spring is thus operable to pull the pivot mounting of the respective leg forwardly of the frame member, thereby urging the seat portion towards its second position.

Each tension spring may include a suitable adjusting device, for example an adjusting knob at the front end of the respective frame member in which the tension spring is arranged.

The seat unit may further include a backrest member carried on the frame structure, for which purpose the frame structure may comprise first and second upstanding frame members at positions rearwardly of the seat portion. The upstanding members are, for example connected by a transversely extending member on which a backrest panel or the like is suitably fixed.

The upper end of each of the upstanding members of the frame structure may also have a pivot mounting for pivotally supporting a respective armrest which is thus pivotable between an at least substantially horizontal position to which it extends besides the seat portion at a respective side thereof, and a raised portion in which it extends at least substantially vertically. In that way the armrests can provide support for the person wishing to stand up from the seat unit, when the armrests are in the lowered or horizontal position. If however the person using the seat wishes to move on to or off the seat unit by moving sideways, or if the person while sitting on the seat wishes to have more space at the sides, for example to dry himself or herself after a bath or shower, the armrests can be pivoted upwardly and thus leave the sides of the seat unit clear.

Preferably, the armrests are so mounted on their pivot mountings that, while they extend in at least substantially mutually parallel relationship in their lowered position, when they are in their raised position the free ends of the armrests, which in the lowered position form the front ends, tend to move outwardly and therefore away from each other, so that when the armrests are raised, each armrest leans outwardly away from the center of the seat unit, to increase the amount of space available at the level of the shoulders of a person sitting on the seat unit.

The seat unit may further comprise a suitable device for holding the seat portion latched or locked in its first or lowered position.

The seat portion may further carry a lid or cover in the usual fashion of a toilet seat cover, which lid or cover can be pivoted upwardly and act as a backrest for the person using the seat, when the seat is in the raised or lowered position. The lid or cover preferably has a stop arrangement to prevent it from being opened beyond a certain raised position, so as effectively to provide a firm back support.

Further objects, features and advantages of the invention will be apparent from the preferred embodiment described below.

DESCRIPTION OF THE PREFERRED EMBODIMENT

Figure 1:
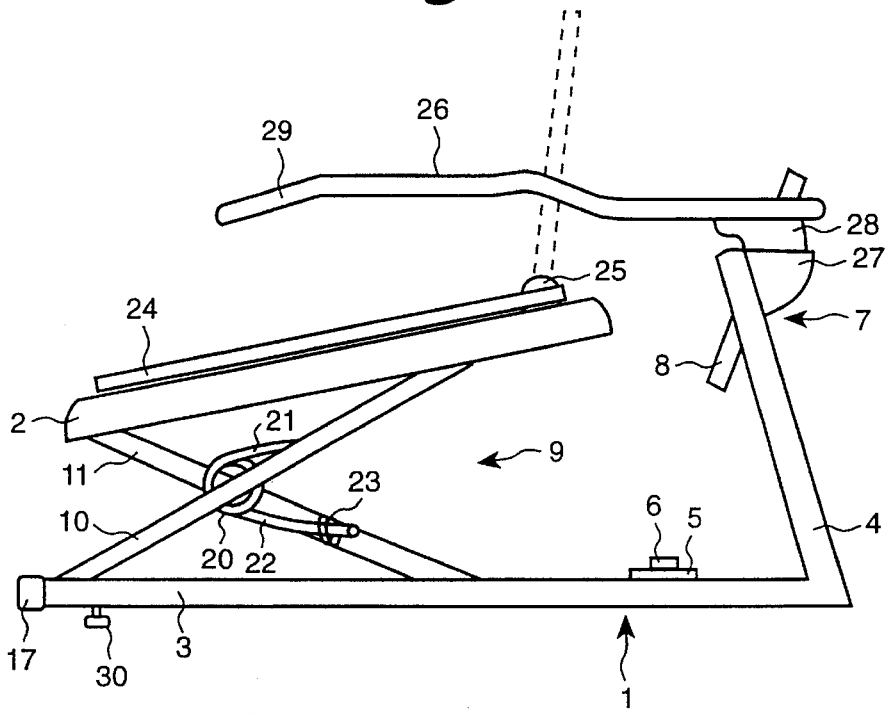
FIG. 1 is a diagrammatic side view of the seat unit with the seat portion in a raised position and the armrests in a lowered position.

Referring firstly to FIG. 1, a seat unit as shown therein comprises a frame structure which is generally indicated by reference numeral 1 and which is so designed that it can be placed on any suitable support arrangement such as a leg assembly, a toilet pan or bowl, or the like. The seat unit illustrated is in the form of a toilet seat unit arranged to be mounted on the rim of a WC bowl or pan, by fixing means which will be described in greater detail hereinafter.

The illustrated seat unit includes a seat portion 2 which will be of a nature suited to the kind of seat unit, for example being upholstered or cushioned if it is an armchair-like seat. In the illustrated embodiment, the seat portion 2 is of a generally conventional toilet seat configuration, for example produced by a standard moulding process using for example ABS.

The frame structure 1 comprises a pair of frame assemblies each consisting of a frame member 3 which in use extends at least substantially horizontally on the WC bowl or pan at respective sides thereof, and an upstanding frame member 4. The two frame assemblies 3 and 4 are disposed at a spacing from each other at respective sides of the WC bowl, at least substantially parallel to each other. The frame assemblies are interconnected by a transversely extending plate member 5 which has therein a pair of transversely extending slots (not visible in the drawing). Suitable fixing screws or bolts as indicated at 6 can be passed through the slots in the plate member 5 for securing the seat unit according to the invention to a WC bowl, using the conventional fixing holes provided in the upper part of the WC bowl. The slots in the plate member 5 permit adjustment of the spacing between the fixing bolts 6, to permit the seat unit to be fitted to different kinds of WC bowls.

The upstanding frame members 4 are also interconnected at the location indicated at 7 by a transversely extending bar member which serves to hold the upstanding members 4 in the correct position and in rigid relationship, while also serving to support a backrest in the form of a back support panel or the like which is indicated at 8 but of which only part can be seen in FIG. 1. The upper edge part of the backrest 8 can be seen projecting above the armrest in FIG. 1.

Operatively disposed between the frame members 3 and the seat portion 2 is a linkage assembly which is generally indicated at 9. As shown in FIG. 1, the assembly 9 comprises first and second pairs of legs 10 and 11 disposed in crossed relationship and pivotably connected at their intersection. The legs 11 are arranged within the legs 10, in other words the spacing between the legs 11 is less than the spacing between the legs 10.

The upper ends of the legs 10 and 11 are pivotably connected to the seat portion 2 by a suitable form of pivot mounting which is hidden within a downwardly extending edge flange configuration of the seat portion and is thus invisible in FIG. 1.

The lower end of each of the legs 10 is pivotably connected by a pivot mounting to the respective frame member 3 at a position adjacent the front end thereof, which is therefore towards the left in FIG. 1.

The lower end of each of the legs 11 is pivotably connected to the respective frame member 3 at a spacing rearwardly of the front end thereof, by means of a slider which will now be described with further reference to FIG. 2.

Figure 2:
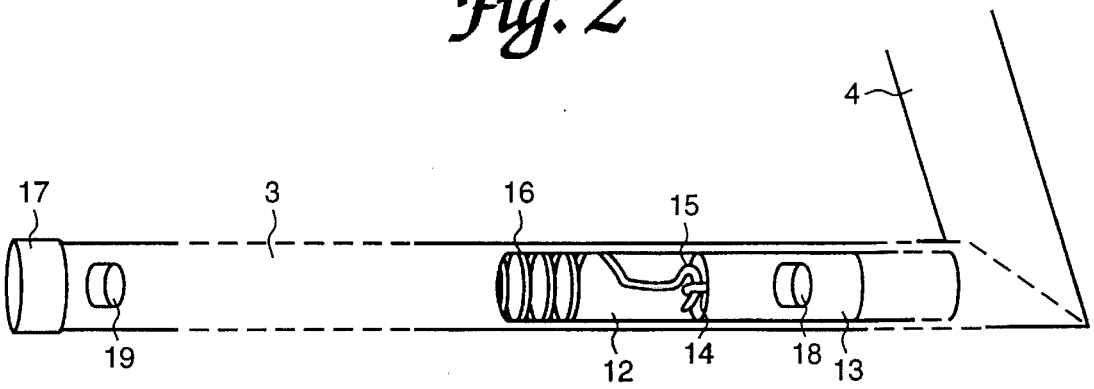
FIG. 2 is a diagrammatic view on an enlarged scale of a detail of the seat unit of FIG. 1.

Looking now at FIG. 2, this is a view onto the inward side of a part of one of the frame members 3 of the frame structure 1 described above with reference to FIG. 1. Reference numeral 4 again denotes just the lower part of the upstanding frame member indicated at 4 in FIG. 1. Formed in the inwardly facing surface of the frame member 3 is a slot 12 which extends in the longitudinal direction of the frame member 3 over a part of the length thereof. Slidably disposed within the frame member 3 in the region of the slot 12 is a slider 13 which is of an external configuration that at least approximately matches the internal configuration of the frame member 3 within which it is slidable, being for example cylindrical. That therefore ensures that the slider 13 can slide within the frame member 3, without tilting or otherwise becoming jammed therein.

The slider 13 has at its end towards the left in FIG. 2 a spring mounting, for example a hook-like portion, as indicated at 14. Engaged with the hook portion 14 is a hooked end 15 of a coil tension spring 16 which extends in FIG. 2 from the slider 13 towards the left and thus within the frame member 3. The other end of the tension spring 16, which is towards the left in FIG. 2, is suitably fixed to the frame member 3, for example by being connected to an adjusting device such as a rotary knob as indicated at 17 in FIG. 2. Rotation of the adjusting knob 17 makes it possible to adjust the pulling force that can be applied by the spring 16.

The slider 13 further carries a pivot mounting 18 on which the lower end of the respective leg 11 of the scissor assembly 9 shown in FIG. 1 is pivotably connected.

Reference numeral 19 in FIG. 2 indicates a similar pivot mounting for pivotably mounting the lower end of the respective leg 10 in FIG. 1.

It will be seen therefore that, when the seat portion 2 of the seat unit as shown in FIG. 1 moves downwardly from the raised position illustrated in FIG. 1, the leg 10 connected to the frame member 3 at the pivot mounting 19 in FIG. 2 will pivot about the mounting 19. At the same time the lower end of the leg 11 which is pivotably mounted to the mounting 18 shown in FIG. 2 will also pivot about the mounting 18. However, the downward movement of the seat portion 2 will necessarily involve an increase in the spacing between the lower ends of the legs 10 and 11 at the respective frame member 3, and that increase in spacing will cause the slider 13 shown in FIG. 2 to be displaced in the lengthwise direction of the frame member 3, more specifically, towards the right in FIG. 2. That displacement of the slider 13 will take place against the pulling force of the tension spring 16. The tension spring 16 in each frame member 3 is thus operative to urge the seat portion 2 towards the raised position illustrated in FIG. 1.

Referring again to FIG. 1, the seat unit according to the invention also includes a spring assembly as indicated generally at 20 in FIG. 1. The spring assembly 20 comprises a torsion spring at each side of the seat unit, in association with the respective pairs of legs 10 and 11. Each torsion spring comprises at least one annular portion or turn around a mounting shaft or spindle forming the pivotal connection between the crossed legs 10 and 11. The position of the annular spring portion can be seen in the side view in FIG.

1, showing that it is disposed between the respectively adjacent legs 10 and 11.

Each torsion spring further includes first and second legs 21 and 22. The free end of the leg 21 bears against a suitable stop such as a retaining hook which is disposed on the leg 10 of the scissor assembly, on the inside side thereof which is therefore not visible in FIG. 1. Similarly, the free end of the leg 22 bears against a suitable stop or retaining hook as indicated at 23 on the outward side of the adjacent leg 11. The springs 20 are operable to urge the seat portion 2 towards the position shown in FIG. 1 in which it is raised and tilted forwardly, relative to the frame structure 1.

The seat unit further includes a lid or cover 24 which is pivotably mounted to the seat portion 2 by a pivot as indicated at 25. The seat portion 2 further includes a suitable stop arrangement to engage the lid 24 when it is in a raised position as shown in broken lines in FIG. 1, so that the lid 24 will then form a secure beck support for a person sitting on the seat portion 2.

It will be noted at this point that the seat portion 2 may be mounted on the scissor assembly formed by the legs 10 and 11 in such a way that it can be raised therefrom, for example to permit it to be lifted for cleaning in the usual fashion. Alternatively, the seat portion 2 can be mounted to the leg assembly 10 and 11 by a snap-engagement retaining arrangement which permits the seat portion 2 to be disengaged from the leg assembly 10 and 11 for cleaning purposes. For example, the retaining arrangement may be so designed that, without the use of tools, the seat portion 2 can be pulled forwardly of the leg assembly 10 and 11 by a forcible movement and then lifted to disengage the seat portion 2 from the leg assembly 10 and 11.

The seat unit according to the invention further has a pair of armrests of which one is indicated at 26 in FIG. 1. The armrest 26 is pivotably mounted on mounting plates 27 carried at the upper end portion of each of the respective upstanding frame members 4. For that purpose the armrest has a mounting plate 28 which is pivotally connected to the mounting plate 27. The mounting plate 27 has internal abutments which are so designed that the armrest 26, whether in its lowered position as shown in solid lines in FIG. 1 in which it extends at least substantially horizontally, or in its raised position in which it extends at least substantially vertically, will always be is in such a position that no part thereof or of the mounting plate 28 can for example trap a finger or other part of the anatomy of the person using the seat between components of the pivot mounting for the armrest 26. Guard devices may be specifically provided to prevent entrapment of fingers and hands and like injury.

Each armrest 26 extends from its pivot mounting at 27, 28 forwardly at least substantially parallel to the respective frame members 3. It will be seen that the front end portions 29 of each armrest 26 slope downwardly as that is more ergonomically suited to the position of the hands of a person using the armrests 26 to push upwardly from a seated position in the seat unit.

Figure 3:
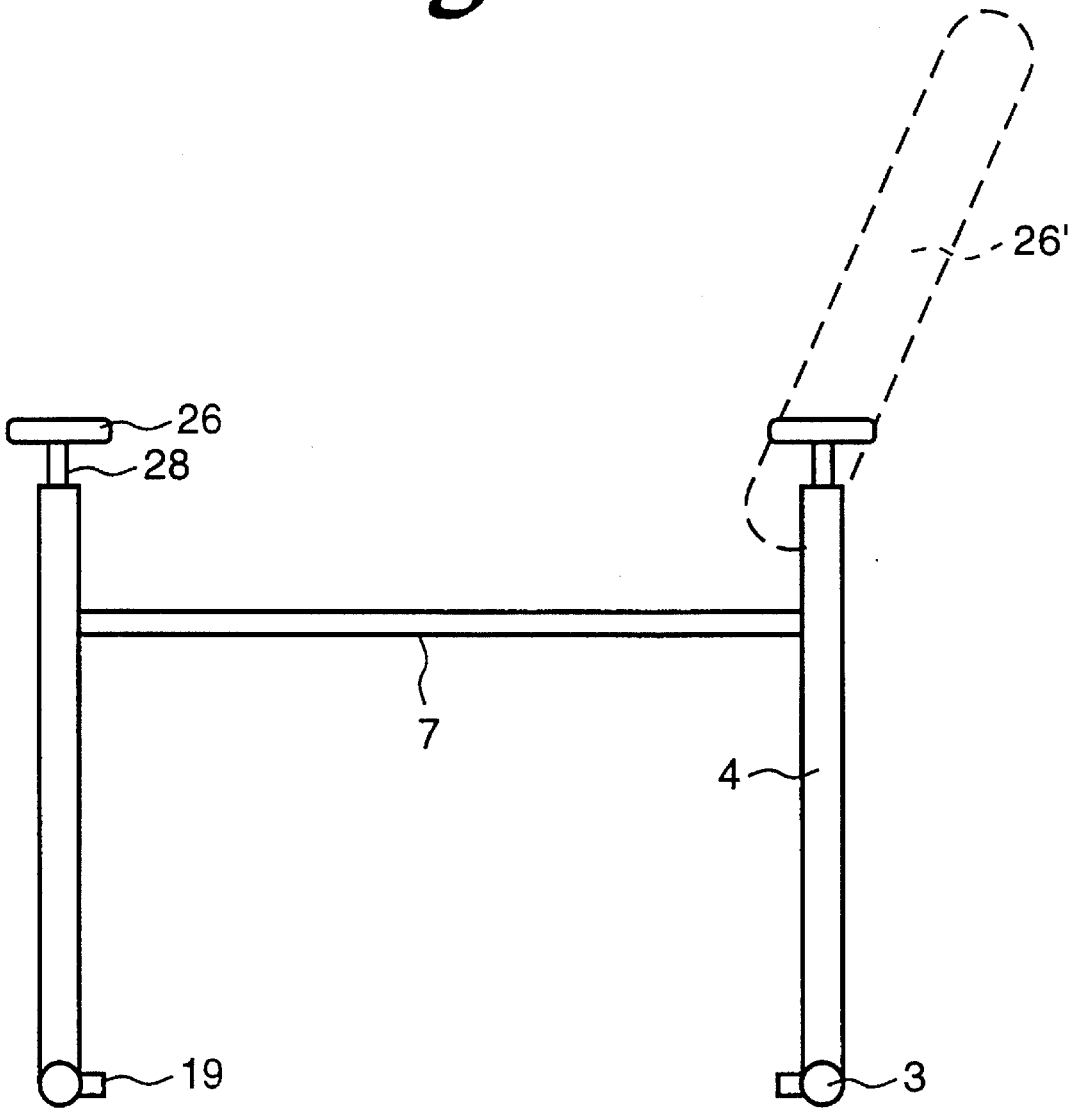
FIG. 3 is a front view of part of the seat unit shown in FIGS. 1 and 2.

Furthermore, as can be seen from FIG. 3, the armrests 26 are so arranged that, while they extend parallel to the frame members 3 and to each other in their lowered position, they are mounted on the mounting plates 28 in an angled relationship in such a way that, as the armrests 26 move upwardly, into the broken-line position shown at 26' in FIG. 3, the forward free ends 29 of the armrests 26 also move outwardly until finally in the fully raised position 26' shown in broken lines in FIG. 3 the armrests 26 are splayed outwardly to give more space for the shoulders of the person using the seat unit.

The mode of operation of the illustrated seat unit is as follows:

Assuming that the seat unit is in the position shown in FIG. 1, a person wishing to use it simply sits on the seat portion 2, with the lid 24 raised, the weight of that person thus causing the seat portion 2 to move downwardly until it comes to rest in a stable position upon the frame structure 1. The tension springs 16 are put under an increased tension by virtue of the displacement of the legs 10 and 11 and the resulting sliding movement of the sliders 13 within the frame members 3, and the torsion springs 20 are similarly put under an increased torsional stress. The springs 16, 20 resist the downward movement of the seat portion 2 but are insufficiently strong to prevent that movement from taking place. When then the person sitting on the seat portion wishes to stand, he or she uses his or her own muscular strength to initiate upward movement of the body, and that will be further assisted by the force of the tension springs 16 and torsion springs 20. As the seat portion 2 moves upwardly away from the frame structure 1, the scissor leg assembly 10 and 11 will cause the rearward part of the seat portion 2 to rise at a greater rate, so that, not only is the person lifted bodily, but also tends to be tilted forwardly. As a result, the person can then more readily stand up by virtue of being tipped forwardly on to the person's own feet.

It will be seen that the combined force of the springs 16 and 20 is such as to give the person using the seat unit, substantial assistance in moving towards a standing position while however, requiring that person to apply some physical effort in attempting to stand up. The fact that the user of the seat unit has to apply a physical force to stand up also has a therapeutic effect, as the person does not become totally dependent on the power of the seat unit when seeking to stand but still has to use muscular force.

The force of the springs 16 can be adjusted to suit the bodyweight of the person using the seat, by means of the adjusting knobs 17. It would also be possible to vary the strength of the torsion springs 20 in some suitable fashion, for example by the provision of an adjusting means, or by fitting springs of varying forces according to bodyweight, or the like.

It will be noted in regard to the position of the connecting spindles connecting the respective legs 10 and 11 where they cross, that it is desirable for the lengths of the leg portions which are to the left of the pivotal connection in FIG. 1 to be for example half the lengths of the corresponding leg portions which are towards the right of the connecting point in FIG. 1. Thus the length of the leg portion from the bottom left-hand pivot mounting at 19 (see FIG. 2) along the leg 10 to the pivotal connection between the legs 10 and 11 is half the length from the pivotal connection along the same leg to the top right-hand end thereof. That arrangement gives the appropriate tilting movement of the seat portion 2.

In regard to the co-operation of the springs 16 and 20, it will be noted that the force of the torsion springs 20 on their own is insufficient to provide a full lifting effect. This is because the force applied by the respective springs 20 progressively decreases as the seat portion 2 moves from the fully depressed position towards the fully raised position in FIG. 1. When the seat portion 2 is in the fully depressed position, the force of the springs 20 is thus at its maximum but decreases virtually to zero when the seat portion 2 is in the position of FIG. 1.

On the other hand, when the seat portion 2 is in the fully depressed position, while the tension springs 16 are then extended to the maximum degree, the positions of the legs 10 and 11 means that the lever arms through which the springs 16 act to urge the seat portion 2 upwardly are disadvantageous in regard to transmitting the spring force of the springs 16. When the seat portion 2 is fully depressed therefore, the springs 16 can make only a very slight contribution to moving the seat portion 2 in an upward direction, from its fully depressed position.

As, however, the seat portion 2 moves upwardly, the springs 16 are able to exert a more highly effective spring force by virtue of the changes in the relative positions of the legs 10 and 11, and thus increasingly contribute to the spring force urging the seat portion 2 towards its fully raised position.

It will be seen therefore that, while the effective spring force of the torsion springs 20 decreases as the seat portion 2 moves upwardly, the effective spring force of the tension springs 16 increases during that movement. The springs 16 and 20 can thus be suitably arranged and adjusted to provide that the seat portion 2 moves from its fully downward position to its fully raised position with a desired spring characteristic and at a desired rate, so as to give a smooth controlled upward movement of the seat portion 2 without any tendency to 'catapult' the seat occupant out of the seat, but also without any tendency to come to a halt before the occupant has been lifted into the fully raised position of the seat portion 2.

Reference numeral 30 in FIG. 1 indicates a locking lever or catch which is mounted pivotably on the frame member 3 and which has for example a locking hook arranged to engage with a suitable part of the seat portion 2 in order to latch the seat portion 2 in the lowered position. The lever 30 may be mounted loosely removably on a mounting projection on the frame member 3 at one side, with the frame member 3 at the other side having a similar mounting projection, so that the lever 30 can be easily removed from one side of the seat unit and fitted to the frame member 3 at the other side of the seat unit, according to the requirements of the specific user.

It will be appreciated that the seat unit has been described only by way of example and that other modifications and variations may be made in the seat unit without thereby departing from the scope of this invention. For example, it would be possible to use different forms and numbers of springs. It would also be possible to use a different form of linkage assembly interconnecting the frame structure 1 and the seat portion 2, for example a parallelogram-like linkage assembly, which provides for the combined upward/downward movement and pivotal or tilting movement of the seat portion of the seat unit.

What is claimed is:

1. A seat unit, comprising:

a frame structure;

a seat portion for a person using the seat unit to sit upon;

a linkage means interconnecting said frame structure and said seat portion for displacement of said seat portion relative to said frame structure between a first position with said seat portion lowered into a sitting position for the person using the seat unit, and a second position in which said seat portion is raised to provide assistance for the person using the seat unit to stand up therefrom, said linkage means being operable to cause a rearward part of said seat portion to be raised by a greater distance than a front part of said seat portion when moving from said first position into said second position, whereby said seat portion, in lifting from said first position towards said second position, also tilting forwardly;

a first spring means urging said seat portion towards said second position; and a second spring means urging said seat portion towards said second position, said first and second spring means being operable in combination to produce an overall spring force urging said seat portion from said first position towards said second position with a spring force value which is of a desired magnitude in each part of a range movement of said seat portion towards said second position;

said linkage means comprising a scissor-type assembly having legs constituting said assembly being of respective lengths such as to produce said tilting of said seat portion;

said legs comprising a first pair of legs and a second pair of legs, with said first and second pairs of legs being in crossed relationship;

means pivotally connecting said pairs of legs together in such a way that leg portions of each pair of legs at one side of the respective said pivotal connecting means are shorter than leg portions of each pair at its other side of said pivotal connecting means, thereby to produce said forward tilting movement of said seat portion as said seat portion moves towards said second position;

said first spring means comprising a torsion spring disposed at said pivotal connecting means, said torsion spring having leg portions urging said seat portion towards said second position; and said second spring means comprising at least one tension spring having an effective spring force acting on a respective said leg wherein the effective spring force of said tension spring increases by a change in position of the said pairs of legs when producing said forward tilting movement of said seat portion as said seat portion moves towards said second position.

2. A seat unit according to claim 1, wherein:

said first and second spring means co-operate in such a way that said overall spring force urging the seat portion towards said second position is at least substantially constant over said range of movement from said first position towards said second position.

3. A seat unit according to claim 1, wherein:

said frame structure comprises first and second hollow frame members.

4. A seat unit according to claim 3, wherein:

said frame structure has a front, and each of said frame members accommodates a respective said tension spring having one end toward said front of said frame structure.

5. A seat unit according to claim 4, wherein:

each said tension spring has a second end;

a respective slider being slidably disposed in each respective frame member, and said second end of each tension spring being connected to a respective said slider.

6. A seat unit according to claim 5, wherein: each said slider carries a pivot mounting for pivotal connection thereto of respective said leg of said scissor-type assembly, whereby each said tension spring is operable to pull the pivotal connecting means of said respective leg forwardly of the respective said frame member, thereby urging said seat portion towards said second position.

7. A seat unit according to claim 4, further including:

an adjusting means operatively associated with at least one said tension spring.

8. A seat unit according to claim 1, further including:

a backrest member carried on said frame structure.

9. A seat unit according to claim 8, wherein: said frame structure comprises first and second upstanding frame members located at positions rearwardly of said seat portion.

10. A seat unit according to claim 9, said frame structure further including:

a transversely extending member connecting said upstanding frame members, and a support means on said transversely extending member.

11. A seat unit according to claim 9, wherein:

each of said upstanding frame members has an upper end which has a pivot mounting pivotally supporting a respective armrest which is thereby pivotable between an at least substantially horizontal position in which said armrest extends beside said seat portion at a respective side thereof, and a raised position in which said armrest extends at least substantially vertically.

12. A seat unit according to claim 11, wherein:

said armrests each have a free end and are so mounted on respective of said pivot mountings that, while said armrests extend in at least substantially mutually parallel relationship in said at least substantially horizontal position, when said armrests are in said raised position said free ends of said armrests, which in said at least substantially horizontal form front ends, tend to move outwardly and away from each other so that when said armrests are raised, each said armrest leans outwardly away from a center of said seat unit.

13. A seat unit according to claim 1, further comprising:

a device for holding said seat portion in said first position.

14. A seat unit according to claim 1, further including:

a cover carried by said seat portion and adapted to be pivoted upwardly to act as a backrest for the person using the seat unit, when said seat portion is in said first or second position.

15. A seat unit according to claim 14, further including:

a stop means for said cover and operative to prevent said cover from being opened beyond a defined raised position.

* * * * *